United States Patent [19]

Iimura

[11] Patent Number: 4,580,711

[45] Date of Patent: Apr. 8, 1986

[54] GRIPPER DEVICE

[75] Inventor: Yoshitaka Iimura, Toyama, Japan

[73] Assignee: Yoshida Kogyo K. K., Tokyo, Japan

[21] Appl. No.: 668,495

[22] Filed: Nov. 5, 1984

[30] Foreign Application Priority Data

Nov. 26, 1983 [JP] Japan ..... 58-222994

[51] Int. Cl.[4] ..... B65H 20/00

[52] U.S. Cl. ..... 226/158; 226/173

[58] Field of Search ..... 226/158–162, 226/167, 173, 141; 53/300, 329, 389, 559

[56] References Cited

U.S. PATENT DOCUMENTS

| | | | |
|---|---|---|---|
| 4,059,212 | 11/1977 | Ledgerwood | 226/141 |
| 4,072,260 | 2/1978 | Dove | 226/173 |
| 4,336,680 | 6/1982 | Grevich | 53/389 |
| 4,489,873 | 12/1984 | Yoshida et al. | 226/162 |

FOREIGN PATENT DOCUMENTS

| | | | |
|---|---|---|---|
| 3001742 | 7/1981 | Fed. Rep. of Germany | 226/173 |

*Primary Examiner*—Leonard D. Christian

*Attorney, Agent, or Firm*—Hill, Van Santen, Steadman & Simpson

[57] ABSTRACT

A gripper device which is a part of a slide-fastener finishing apparatus and which is used to grip and take out completed fasteners successively by grippers reciprocally moved along the fastener flow direction.

The improvement comprises placing a driven belt-like member in an endless fashion over two rotation wheels, the wheels being positioned on an extended line of fastener flow at predetermined intervals, mounting two gripper-equipped members on the belt-like member at equal intervals, each gripper equipped member including a gripper which is movably mounted so as to be able to align with the center of the completed fastener outlet port, moving each gripper-equipped member to the completed fastener outlet port by rotating the rotation wheels in forward and reverse directions, and then gripping and taking out the completed fasteners with each gripper.

The gripper device according to the invention enables the efficiency of taking out completed fasteners to be improved, and the continuous finishing process of fasteners to be speeded up.

2 Claims, 4 Drawing Figures

GRIPPER DEVICE

BACKGROUND OF THE INVENTION

The present invention relates to a gripper device, and more specifically to a gripper device which is a part of a slide-fastener finishing apparatus and which is used for taking out completed fasteners by gripping them.

DESCRIPTION OF THE PRIOR ART

FIG. 1 shows a slide-fastener finishing apparatus of known type in a simplified manner, in which the relation between fastener chain and a gripper is shown. (Reference to be made to Japanese Patent Publication No. 12543/1969) The gripper device is used to take out completed fasteners at the final stage of continuous finishing of slide fasteners. FIG. 1 shows a completed fastener chain being pulled out by a gripper A after a bottom stop C, a slider D, and a top stop E have been attached. The fastener chain is then cut by upper and lower cutters B, B. The gripper A moves to the right as viewed in FIG. 1, further guiding the completed fastener to the outside of the apparatus, and opens at a predetermined location to drop the fastener, the fasteners being accumulated therebelow. The gripper A then returns toward the left as viewed in FIG. 1 to its original position to grip the next fastener chain. As described above, a single gripper was reciprocally moved to take out completed fasteners in the past practice. This method, however, was inefficient in taking out completed fasteners and prevented speeding up of the continuous finishing process.

SUMMARY OF THE INVENTION

Therefore, it is an object of the present invention to provide a gripper device to be used in the finishing process of slide fasteners which has high efficiency in taking out the slide fasteners.

Another object of the present invention is to provide a gripper device which allows speeding up of the continuous finishing process of slide fasteners.

These and other objects have been attained in a gripper device which is a part of a slide-fastener finishing apparatus and which is used to grip and take out completed fasteners with grippers reciprocally moved along the fastener flow direction, by placing a driven belt-like member in an endless fashion over two rotation wheels, the wheels being positioned along an extended line of fastener flow at predetermined intervals, mounting two gripper-equipped members on the belt-like member at equal intervals, each gripper-equipped member including a gripper which is movably mounted so as to be able to align with the center of the completed fastener outlet port, moving each gripper-equipped member to the completed fastener outlet port by rotating the rotation wheels in forward and reverse directions, and then gripping and taking out the completed fasteners with each gripper.

Since the present invention is constructed as described above, the gripper device according to the present invention brings about the following effects:

The efficiency of taking out completed fasteners is doubled compared with a conventional gripper device having one gripper, because in the gripper device of the present invention using two grippers, each gripper works alternately to take out completed fasteners efficiently; that is, when one gripper is moving back taking out a completed fastener, the other gripper is moving forward toward the fastener outlet port. Thus the continuous finishing process of slide fasteners is speeded up.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of same in any way.

DETAILED DESCRIPTION OF THE PREFERRED EMBODIMENTS

Figure 1:
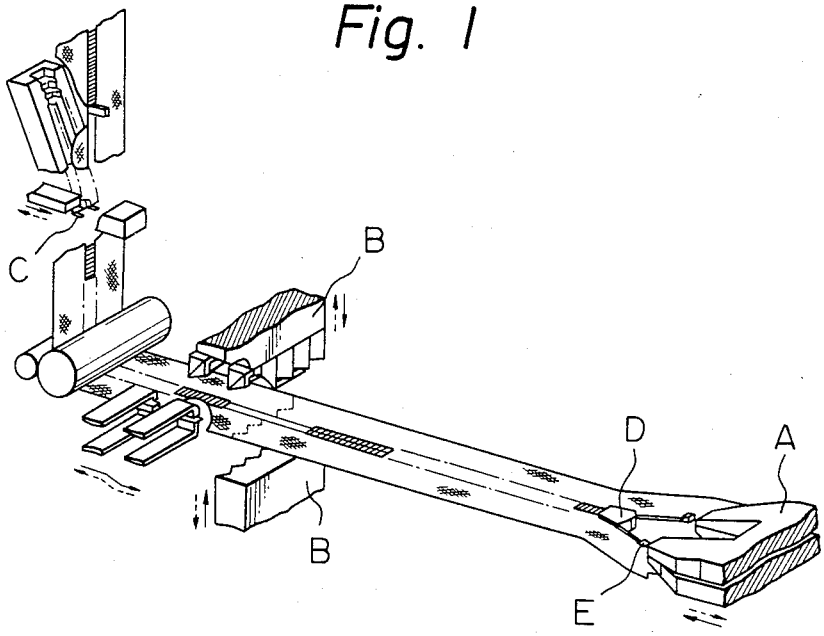
FIG. 1 is a perspective view showing a conventional fastener finishing apparatus in a simplified manner.
Figure 2:
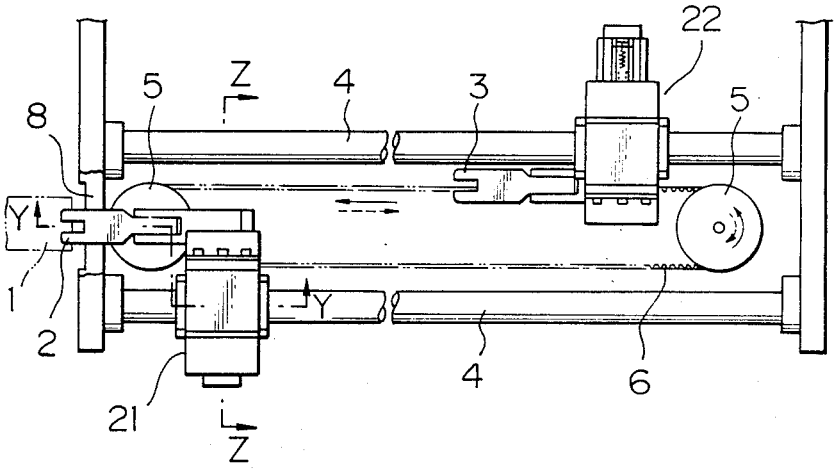
FIG. 2 is a plan view showing the whole arrangement of the present invention.

FIG. 2 shows the whole arrangement of the gripper device according to the invention. In FIG. 2, a timing belt 6 is placed in an endless fashion over two gears 5, 5 which are positioned at predetermined intervals on an extended line of fastener flow direction. Gripper-equipped members 21, 22 which are slidably fitted onto guide bars 4, 4 on both sides are mounted on the timing belt 6 at equal intervals. By rotating the gears 5, 5 in forward and reverse directions, the timing belt 6 is reciprocally moved as shown by arrows in FIG. 2. Thus, the gripper-equipped members 21, 22 mounted on the timing belt 6 are moved along the guide bars 4, 4 alternately to the completed fastener outlet port 8. At or near the outlet port 8, grippers 2, 3 which are included in the gripper-equipped members 21, 22 are moved to align with the center of the outlet port 8 as described below in detail. Then grippers 2, 3 are closed to grip the end portion of the completed fastener chain. The completed fastener chain is pulled by the gripper and is cut by cutters in the same manner as described before. The completed fasteners 1 are then pulled out toward the accumulation position, where each gripper 2, 3 is opened to drop the completed fasteners 1. Each gripper 2, 3 is then returned again to the completed fastener outlet port 8. Since two gripper-equipped members are mounted on the endless timing belt 6 at equal intervals and the belt is moved reciprocally, while one gripper equipped member is pulling out a completed fastener, the other gripper-equipped member is moved to the outlet port 8 to grip the next completed fastener. This allows the efficiency of taking out completed fasteners to be improved. The gripper device according to the invention is explained further hereinbelow.

Figure 3:
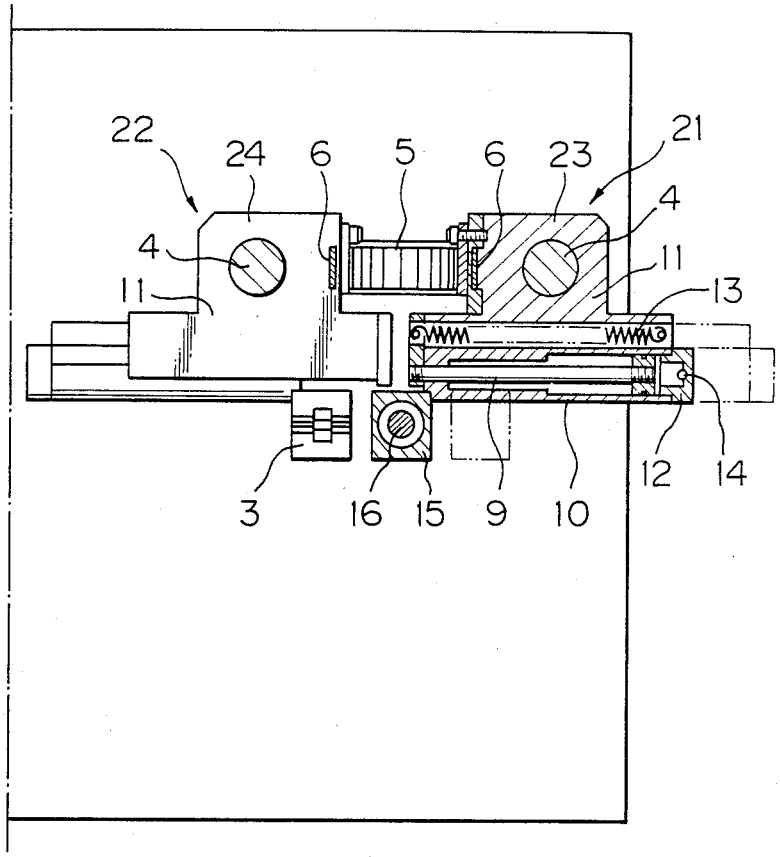
FIG. 3 is a sectional view along the line Z—Z of FIG. 2 showing the mechanism of a gripper movement according to the invention.

FIG. 3 is a sectional view along the line Z—Z of FIG. 2, which shows the mechanism for moving grippers 2, 3 to the center of the outlet port 8 as they approach the outlet port 8. In FIG. 3, the gripper 2 (see FIG. 2) has been moved to the center of the outlet port 8. The main bodies 23, 24 of the gripper-equipped members 21, 22 fitted onto guide bars 4, 4 placed on both sides of the gripper device form ram guides 11, 11 at their lower portions. Reference is made to the right portion of FIG. 3 where a sectional view is shown. A ram cylinder 10 is slidably mounted on the ram guide 11 and is pulled leftward as viewed in FIG. 3 by a spring 13. The spring 13 is fixed to the ram guide 11 at its left end. A gripper cylinder 15 having a gripper 2 is fixed perpendicularly to the ram cylinder 10. The ram cylinder 10 has a head cover 12, into which an air pipe 14 is led. By charging and discharging air into the head cover 12 of the ram cylinder 10, the ram cylinder 10 moves reciprocally to the right and left as shown by solid lines and phantom lines in FIG. 3. This movement allows the gripper 2 to be moved to and from the center of the outlet port 8. Specifically, since the piston 9 is fixed to the ram guide 11 at its left end as viewed in FIG. 3, when air is charged into the head cover 12 of the ram cylinder 10 through the air pipe 14, the ram cylinder 10 moves along the fixed piston 9 rightward against the force of the spring 13 (phantom line position in FIG. 3). When air is discharged through the air pipe 14, the ram cylinder 10 is returned to the solid line position of FIG. 3 by the force of the spring 13. This movement of the ram cylinder 10 is for the purpose of avoiding collision between grippers 2 and 3. In order to avoid the collision of a gripper which is taking out a completed fastener along the extended line of fastener chain flow with the other gripper, the gripper is kept in a position not aligned with the center of the outlet port 8 when it is not gripping a fastener. The gripper is moved to the position aligned with the center of the outlet port only when it grips a completed fastener 1 so that it may grip the fastener at a proper position. Thus completed fasteners are pulled straight out along the extended line of fastener chain flow, which is helpful in avoiding damage to the fasteners and in making the removal operation smooth.

Figure 4:
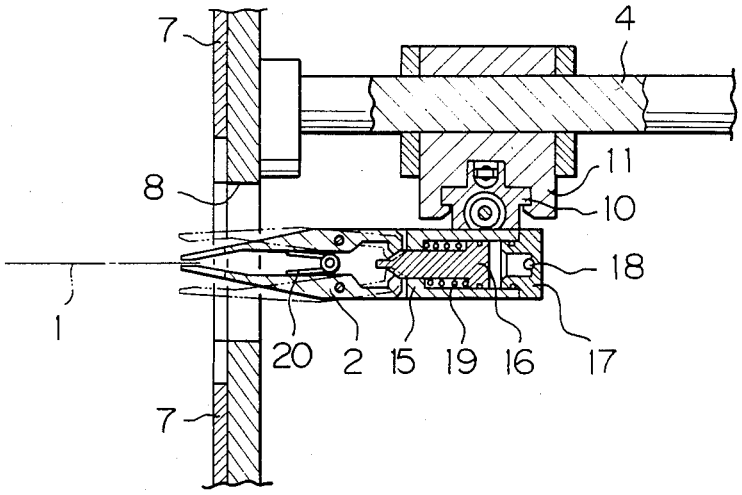
FIG. 4 is a sectional view along the line Y—Y of FIG. 2 showing the gripper portion according to the invention.

FIG. 4 is a sectional view along the line Y—Y of FIG. 2 showing the gripper portion for gripping the completed fasteners. The gripper 2 is positioned at the front end of a gripper cylinder 15 which is mounted on the ram cylinder 10. The gripper 2 is kept open in normal condition by a spring 20. A piston 16 having a conical front end is fitted in the gripper cylinder 15. The piston 16 is always urged toward a retracted position by a spring 19. When the piston 16 is in retracted position, namely when air is not charged into the head cover 17 of the gripper cylinder through an air pipe 18, the gripper 2 is kept open as shown by phantom lines. By charging air through the air pipe 18 into the head cover 17 of the gripper cylinder 15, the piston 16 is moved forward as shown in FIG. 4; and acts upon cam surfaces formed on the gripper 2. Thus, the rear end of the gripper 2 is opened and, as a result, the front end of the gripper 2 is closed. By discharging air through the air pipe 18 into the head cover 17 of the gripper cylinder 15, the piston is moved backward relative to its position as shown in FIG. 4 by spring 19, and the front end of the gripper 2 is opened. In this way, completed fasteners can be gripped and released. The gripper 3 operates in the same manner as the gripper 2.

Although in the embodiment shown in the figures a timing belt is used to move the gripper-equipped members, a chain or rope may be used instead. In such case, sprockets or grooved wheels will be used instead of gears. In addition, although the two gripper-equipped members are positioned in the figures in the same horizontal plane, they can also be positioned in the same vertical plane, so that one is above the other. In this case, a discharge installation such as a shooter will be required so that the lower grip-per-equipped member will not be affected when the completed fastener is released from the upper gripper.

What is claimed is:

1. A gripper device wherein a completed slide fastener is moved to an outlet and taken out successively at one end thereof by grippers reciprocally moved along the fastener flow direction, comprising:

two gears positioned spaced apart on an extended line of fastener flow, a timing belt placed in an endless loop over said two gears, two guide bars provided parallel to each other on opposed sides of said timing belt loop along the longitudinal direction thereof, two gripper carriers, respectively slidably supported on said guide bars and also mounted on said timing belt at equal intervals, a gripper means attached to each said gripper carrier, means provided on each of said gripper carriers for moving said gripper means to a position which is in alignment with the center of said outlet, means for opening and closing each of said gripper means, and means for rotating said two gears in forward and reverse directions, such that said gripper means alternately grip and take out completed fastener.

2. A gripper device according to claim 1, wherein said means for moving said gripper means to a position which is in alignment with the center of said outlet comprises a ram cylinder mounted on said gripper carrier perpendicularly with respect to the direction in which said timing belt is extended, said means for opening and closing said gripper means comprises a piston-cylinder means fixed on said ram cylinder perpendicularly thereto, and said gripper means is disposed at the leading end of said piston-cylinder means and has cam surfaces acted upon by the piston of said piston-cylinder means.

* * * * *